US009375745B2

(12) United States Patent
Finch

(10) Patent No.: US 9,375,745 B2
(45) Date of Patent: Jun. 28, 2016

(54) APPARATUS AND METHOD FOR MOISTENING SANITARY PAPER PRODUCTS

(71) Applicant: Earl Roy Finch, Cold Lake (CA)

(72) Inventor: Earl Roy Finch, Cold Lake (CA)

(73) Assignee: Clean Ends Inc., St. Albert, Alberta (CA)

( * ) Notice: Subject to any disclaimer, the term of this patent is extended or adjusted under 35 U.S.C. 154(b) by 148 days.

(21) Appl. No.: 14/178,827

(22) Filed: Feb. 12, 2014

(65) Prior Publication Data

US 2014/0224893 A1 Aug. 14, 2014

(30) Foreign Application Priority Data

Feb. 13, 2013 (CA) ..... 2806939
Jun. 4, 2013 (CA) ..... 2817604

(51) Int. Cl.

| | |
|---|---|
| ***B05B 15/06*** | (2006.01) |
| ***B05B 9/08*** | (2006.01) |
| *A47K 10/32* | (2006.01) |
| *B05B 12/12* | (2006.01) |

(52) U.S. Cl.
CPC ..... *B05B 15/061* (2013.01); *B05B 9/0861* (2013.01); *A47K 2010/328* (2013.01); *B05B 12/122* (2013.01)

(58) Field of Classification Search
CPC .. B05B 15/061; B05B 9/0861; B05B 12/122; A47K 2010/328
See application file for complete search history.

(56) References Cited

U.S. PATENT DOCUMENTS

| | | | | |
|---|---|---|---|---|
| 3,796,185 | A | 3/1974 | Boone | |
| 4,798,312 | A | 1/1989 | Scheiber | |
| 6,314,971 | B1 * | 11/2001 | Schneider | A47K 10/32 134/122 R |
| 6,467,654 | B1 | 10/2002 | Ayres | |
| 6,820,821 | B2 * | 11/2004 | Linstedt | A47K 3/281 239/222.11 |
| 7,337,989 | B1 | 3/2008 | Penner et al. | |
| 8,395,396 | B2 | 3/2013 | Hagleitner | |
| 8,522,370 | B2 | 9/2013 | Hornsby et al. | |
| 2006/0150318 | A1 * | 7/2006 | Harm | A47K 10/32 4/661 |
| 2007/0051742 | A1 | 3/2007 | Qiu | |
| 2012/0218106 | A1 * | 8/2012 | Zaima | A61L 2/26 340/540 |

FOREIGN PATENT DOCUMENTS

| | | | |
|---|---|---|---|
| EP | 2561820 | A1 | 2/2013 |
| EP | 2364104 | B1 | 3/2014 |

OTHER PUBLICATIONS

Oseland, Richard; Correspondence from the UK Intellectual Property Office, dated Apr. 23, 2014, and attached Search Report dated Apr. 16, 2014, issued in corresponding UK Patent Application No. GB1402171.1; 5 pages in its entirety.

* cited by examiner

*Primary Examiner* — Justin Jonaitis
(74) *Attorney, Agent, or Firm* — Ulmer & Berne LLP

(57) ABSTRACT

An apparatus and method is provided for moistening cleaning materials prior to use. The apparatus has a fluid container configured to dispense fluid onto a section of cleaning material from a nozzle when brought in proximity to a motion sensor positioned near the nozzle. The apparatus has a fluid pump disposed in the body of the apparatus, and a control circuit, operatively connected to the fluid pump and the motion sensor. A battery disposed in the body provides the electrical power to operate the apparatus. The body can be releasably attached to a hanger member configured for suspending the apparatus from a support.

8 Claims, 7 Drawing Sheets

APPARATUS AND METHOD FOR MOISTENING SANITARY PAPER PRODUCTS

CROSS-REFERENCE TO RELATED APPLICATIONS

This application claims priority and the benefit of the filing date under 35 U.S.C. 119 to Canadian Patent Application No. 2,806,939 filed Feb. 13, 2013 and Canadian Patent Application No. 2,817,604 filed Jun. 4, 2013, the contents of which are incorporated herein by reference.

TECHNICAL FIELD

The present disclosure is related to the field of devices for moistening cleaning materials, in particular, dish cloths, face cloths, toilet paper and paper towels.

BACKGROUND

For some individuals, the use of dry toilet paper after having a bowel movement does not provide the cleanliness the individual desires. Moistening toilet paper prior to use can assist in providing the cleanliness the individual cannot find in using dry toilet paper by itself. Similarly, the use of cleaning materials may not provide the desired cleaning ability as compared to a moistened cleaning material.

In order to address this problem the market has developed pre-moistened cleaning materials, for example wet naps, that a user can keep sealed in a container and simply pull out when needed. However, these types of products have a negative environmental impact, for example they remain intact when flushed down a toilet and clog sewage systems. They also fill other public disposal systems such as landfills. Further, they are expensive.

It is, therefore, desirable to provide a device that can moisten known, inexpensive and widely available cleaning materials, such as dish cloths, face cloths, toilet paper, paper towels and sanitary napkins, prior to use thereof.

SUMMARY

Broadly stated, an apparatus is provided for moistening cleaning material prior to use, the apparatus comprising: a hanger member which is configured for suspending the apparatus from a support; a body that is operatively coupled to the hanger member; a fluid container that is operatively coupled to the body and which is configured for storing fluid for moistening the cleaning material; a fluid pump in communication with the fluid container; a nozzle in communication with the fluid pump; a control circuit operatively coupled to the fluid pump; a source of electrical power operatively coupled to the control circuit; and a motion sensor operatively coupled to the control circuit, whereupon the movement of a person's body part close to the motion sensor will actuate the fluid pump, which will dispense an amount of fluid from the fluid container out the nozzle to moisten the cleaning material.

Broadly stated, a method is provided for moistening cleaning material, the method comprising the steps of: providing an apparatus for moistening cleaning material prior to use, the apparatus comprising: a hanger member which is configured for suspending the apparatus from a support; a body that is operatively coupled to the hanger member; a fluid container that is operatively coupled to the body and which is configured for storing fluid for moistening the cleaning material; a fluid pump in communication with the fluid container; a nozzle in communication with the fluid pump; a control circuit operatively coupled to the fluid pump; a source of electrical power operatively coupled to the control circuit; and a motion sensor operatively coupled to the control circuit, whereupon the movement of a person's body part close to the motion sensor will actuate the fluid pump, which will dispense an amount of fluid from the fluid container out the nozzle to moisten the cleaning material; mounting the apparatus on a support; taking a section of cleaning material and placing it beneath the nozzle; and dispensing the amount of fluid onto the section of cleaning material.

In some embodiments, the apparatus can further comprise an extension arm disposed between the hanger member and the fluid container.

In some embodiments, the apparatus can further comprise a disconnect mechanism disposed between the extension arm and the fluid container, the disconnect mechanism configured for releasably attaching the fluid container to the extension arm.

DETAILED DESCRIPTION OF EMBODIMENTS

Figure 1:
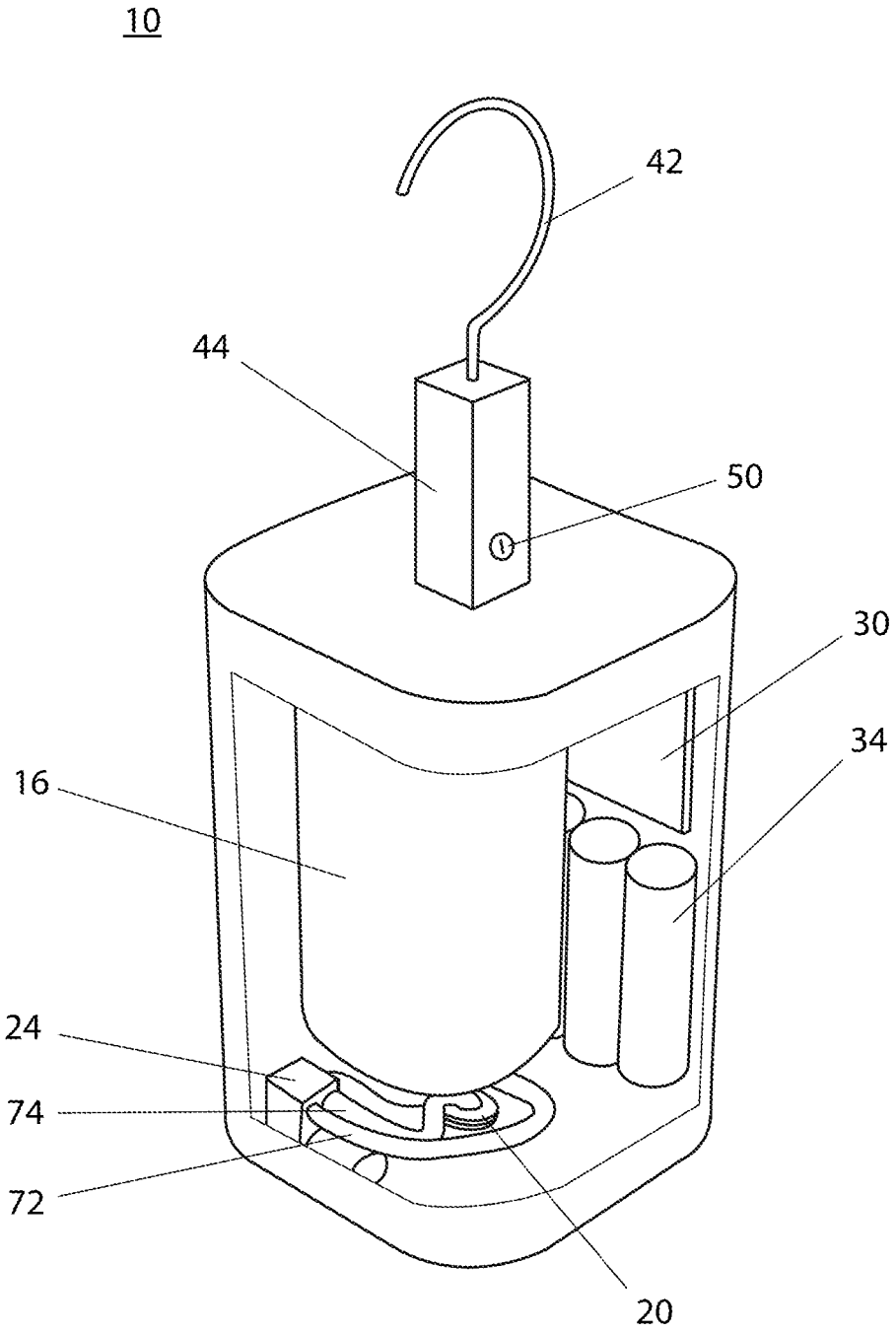
FIG. 1 is a side elevation cut-away view depicting an embodiment of a moistening device.

Referring to FIGS. 1-4, one embodiment of the moveable apparatus 10 for moistening cleaning materials, for example reusable materials such as dish towels or face cloths and disposable materials such as sanitary paper products such as toilet paper, paper towels and sanitary napkins, is shown. In some embodiments, apparatus 10 can comprise body 12, which can further comprise a fluid compartment, a control circuit compartment and a battery compartment. Body 12 can further comprise fluid compartment lid 16 attached thereto via hinge 18, to enclose fluid container 14. Body 12 can also comprise a battery lid 36 attached thereto via hinge 38, to enclose the battery compartment.

Figure 6:
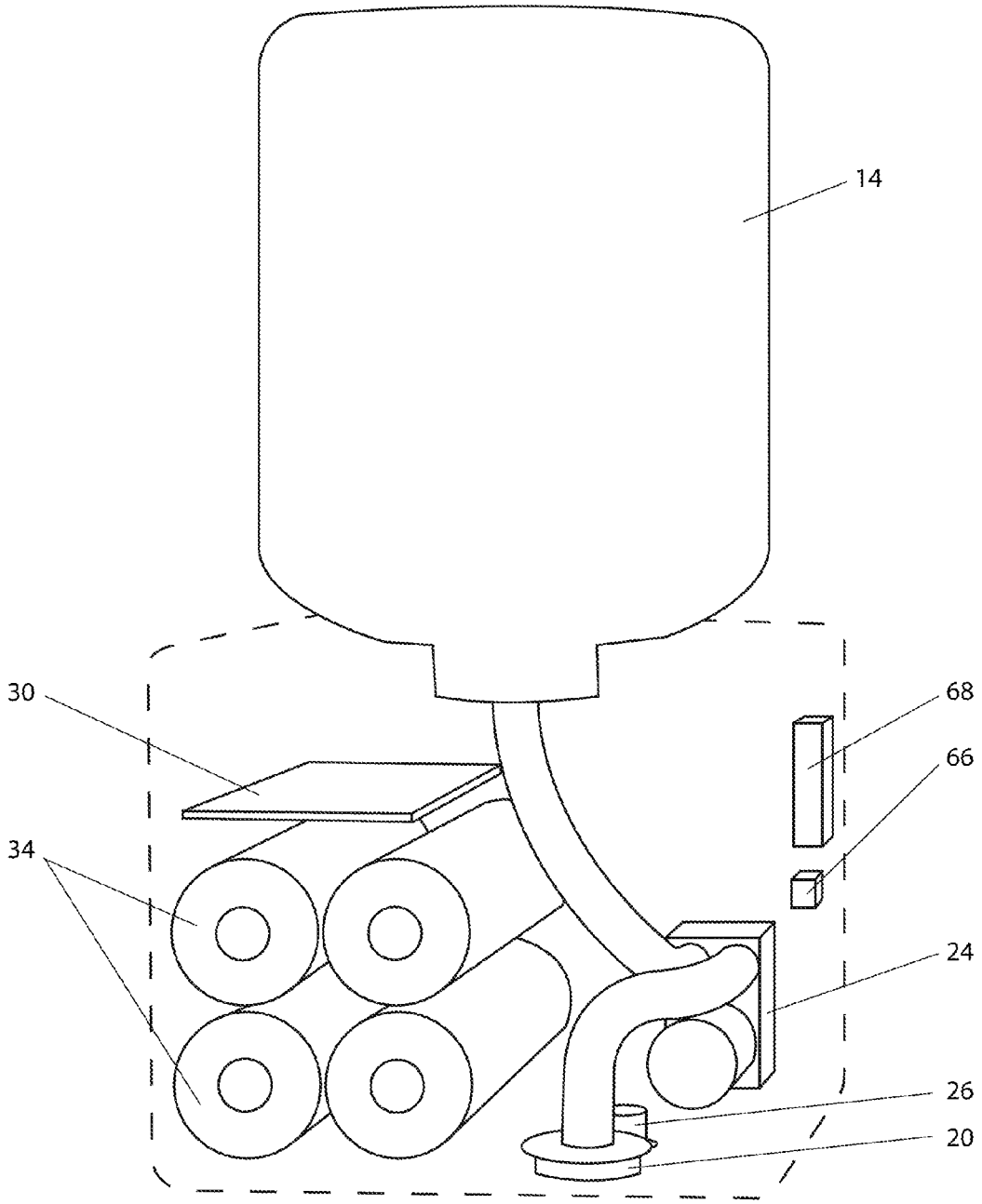
FIG. 6 side elevation partial cut-away view depicting an second embodiment of a moistening device.

While the fluid container 14 may be located within the body (as shown in FIG. 1), the fluid container may alternatively be located adjacent the body (as shown in FIG. 6). The fluid container 14 may be any container or receptacle that has the ability to hold fluid and has an opening to allow fluid communication between the fluid container 14 and a fluid pump 24, which may be connected by a first connector 72. The fluid container 14 may be a compressible bottle, a rigid bottle, a pouch or a bag. The fluid contain 14 may be refillable or non-reusable and designed for one-time use.

A connector element 76 may be positioned within or adjacent to the opening of the fluid container 14 and disposed on one end of first connector 72. The connector element 76 may be used to assist with the fluid transfer from the fluid container 14 to the first connector 72. The first connector 72 may also connect to the fluid pump 24, via a second end, to allow fluid communication there between.

The fluid pump 24 can be located within the fluid compartment and disposed between the fluid container 14 and nozzle 20. Fluid from the fluid container 14 enters the fluid pump 24 and is then pumped through the fluid pump 24 to a nozzle 20, which may be via a second connector 74.

The nozzle 20 may extend through the body 12 or be positioned outside the body 12. Alternatively the nozzle 20 may be positioned within the body 12, such that the dispensed fluid passes through an opening in the body 12. The nozzle 20 functions to dispense the fluid and may be a spray nozzle. It is contemplated that when a spray nozzle is used with paper products it would have a low ejection speed so as to not damage the paper product. Alternatively, the nozzle may dispense blobs of fluid.

A control circuit 30 can be disposed in the control circuit compartment, and further operatively connected to the fluid pump 24 and a motion sensor 26. The control circuit 30 can also be operatively connected to light 66 and power switch 68, when present.

At least one battery 34 can be disposed in battery compartment, operatively connected to control circuit 30 via wires (not shown) to provide a means of electrical power for control circuit 30 and operating the fluid pump 24, motion sensor 26 and light 66. As would be understood by a person of skill in the art, power is supplied to the control circuit 30, which then relays that power to the motion sensor 26 and fluid pump 24 (and light 66 when present). When the motion sensor 26 is activated, a signal is sent to the control circuit 30, which then signals the fluid pump 24 to pump fluid from the fluid container 14 to the nozzle 20.

The motion sensor 26 can be operatively connected to control circuit 30. Motion sensor 26 can be disposed on the bottom end the body 12 and may be located centrally or towards one side. It is preferred that the motion sensor 26 is located in close proximity to the nozzle 20 such that when a user holds a cleaning material, which can be dry or moist, under the nozzle 20 the motion sensor 26 is activated. In some embodiments, the motion sensor 26 may be one or more motion sensing elements, such as a capacitive motion sensor, an infrared motion sensor or any other functionally equivalent motion sensor device as well known to those skilled in the art. It is preferred to use a motion sensor with a short range so that it is not unintentionally activated. In some embodiments, the apparatus 10 can dispense liquid once after, for example, a 1.5 to 3 second delay from when the motion sensor 26 is activated.

Figure 5A:
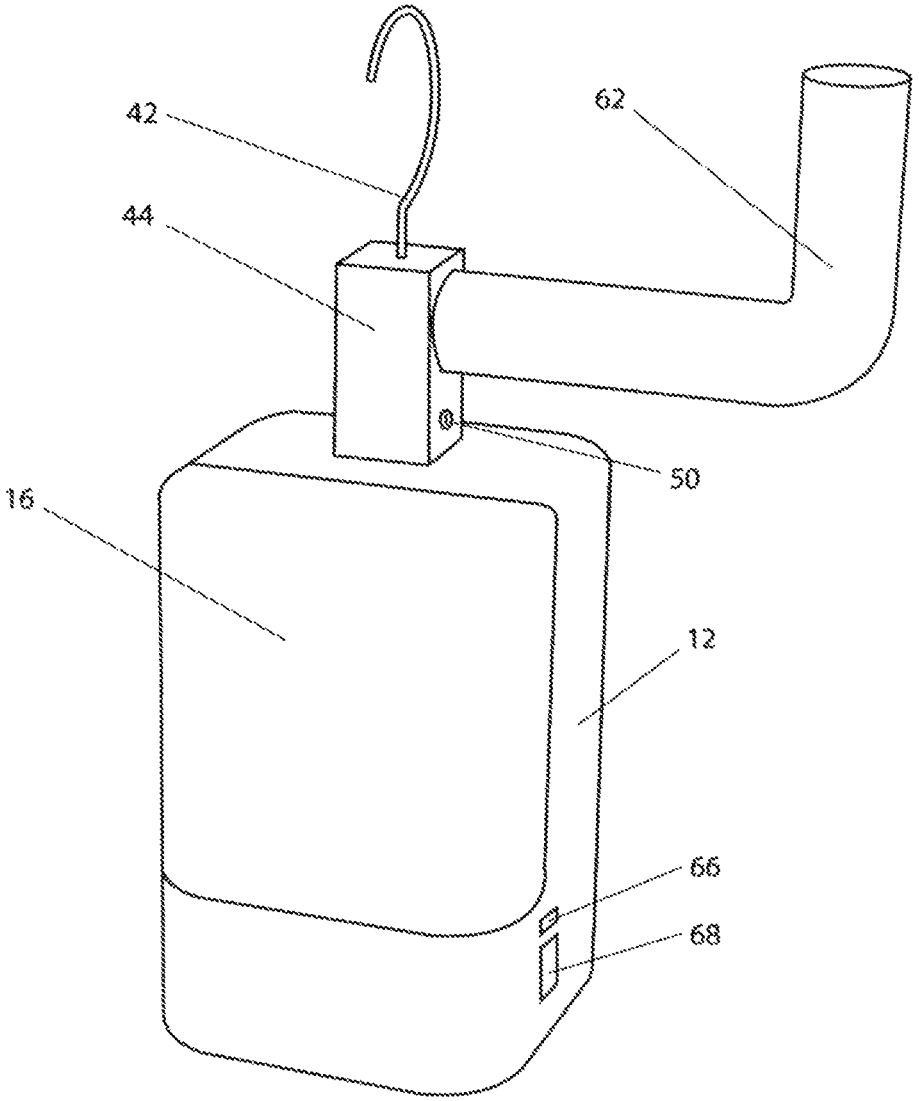
FIGS. 5A and 5B are side elevation views depicting the device of FIG. 1 attached to a support in two different manners.

In some embodiments, apparatus 10 can comprise hanger member 42 operatively coupled to the fluid container 14. In other embodiments the hanger member 42 can be connected to extension arm 44. The hanger member 42 may be rigidly or rotatably connect to the extension arm 44. The extension arm 44 may also include a holder attachment means 70, which allows for attachment to, for example, the end of a paper roll holder 62, such as a toilet paper roll holder or a paper towel holder (as shown in FIG. 5A).

In some embodiments, apparatus 10 can include a disconnect mechanism for allowing the body 12 to be releasably attached to the extension arm 44. One example of a disconnect mechanism can be seen in FIG. 2. Connecting member 46 disposed on the top end of the body 12, passes through an opening 48 in the bottom end of extension arm 44. Attachment means 50 releasably hold the connecting member 46 in place. For example, attachment means 50 may be at least one screw that can be tightened to interact with connecting member 46 and loosened to release the connection between the body 12 and the extension arm 44. The at least one screw may be set screws, which require a specific screw driver to open and therefore prevent unwanted disconnection from the body 12.

In other embodiments (not shown), the disconnect mechanism can comprise a button configured for sliding into a glide track. The button may be disposed on the body 12 or on the extension arm 44, with the corresponding glide track disposed on the other element.

Figure 5B:
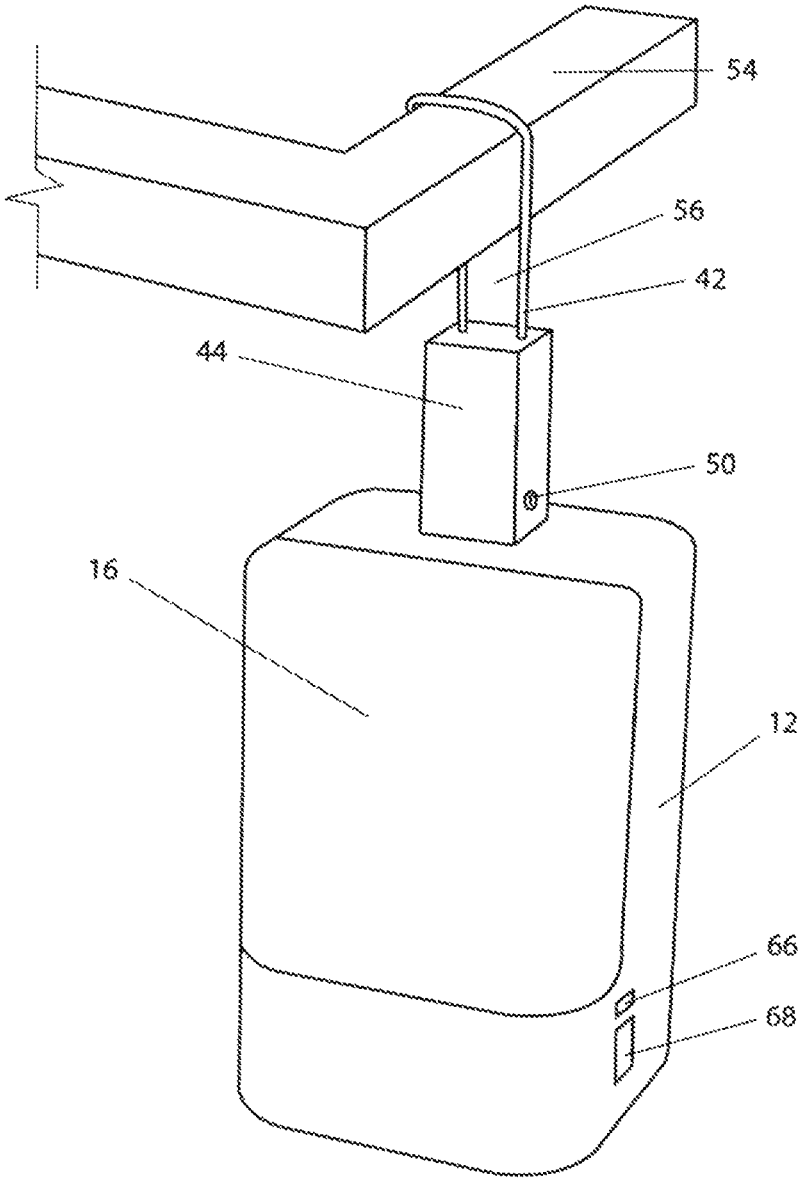

It is contemplated that the apparatus 10 can be moveable and used in a variety of locations. However, one type of hanger member 42 and one length of extension arm 44 will not be appropriate in every situation. Therefore, the hanger member 42 may have a number of different designs. Two examples are shown in FIGS. 5A and 5B, and described in more detail below, although the hanger member design should not be limited to these examples. Similarly, it is possible to provide extension arms of different lengths and sizes.

The disconnect mechanism may be used to change out the extension arm 44 to one that better suits the location of its use. Therefore, it is possible to easily move the apparatus 10 from one location to another, as desired. Further, the disconnect mechanism allows a user to efficiently examine many components of the apparatus 10 without having to remove the hanger member 42 from its position.

Referring to FIGS. 5A and 5B, the hanger member 42 may have a variety of different designs. In FIG. 5A the hanger member 42 is shown having a hook shape and suspended from a paper roll holder 62 via the holder attachment means 70. Such attachment means may be screws, adhesive, lock and key arrangement or other similar means as would be known to a person of skill in the art. The apparatus 10 may also be suspended via the hanger member 42. In FIG. 5B apparatus 10 is shown suspended from a support 54, and the hanger member 42 attaches at both ends to the extension arm 44, forming an inverted U-shape having an opening 56. The method of attachment of a U-shaped hanger member is not shown, but could include a latch or fastener, and would be known to a person of skill in the art.

Figure 2:
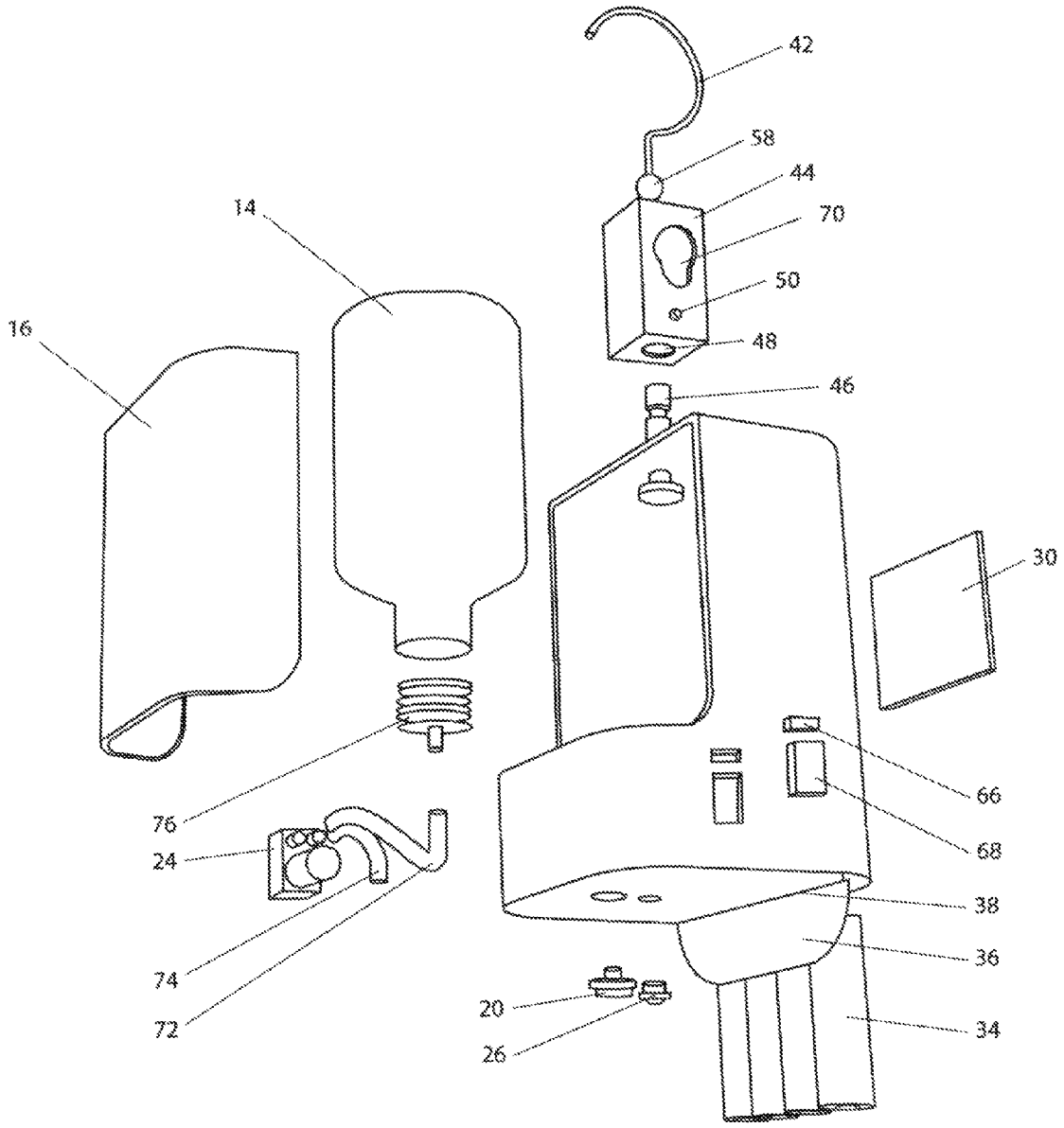
FIG. 2 is an exploded view of the device of FIG. 1.
Figure 3:
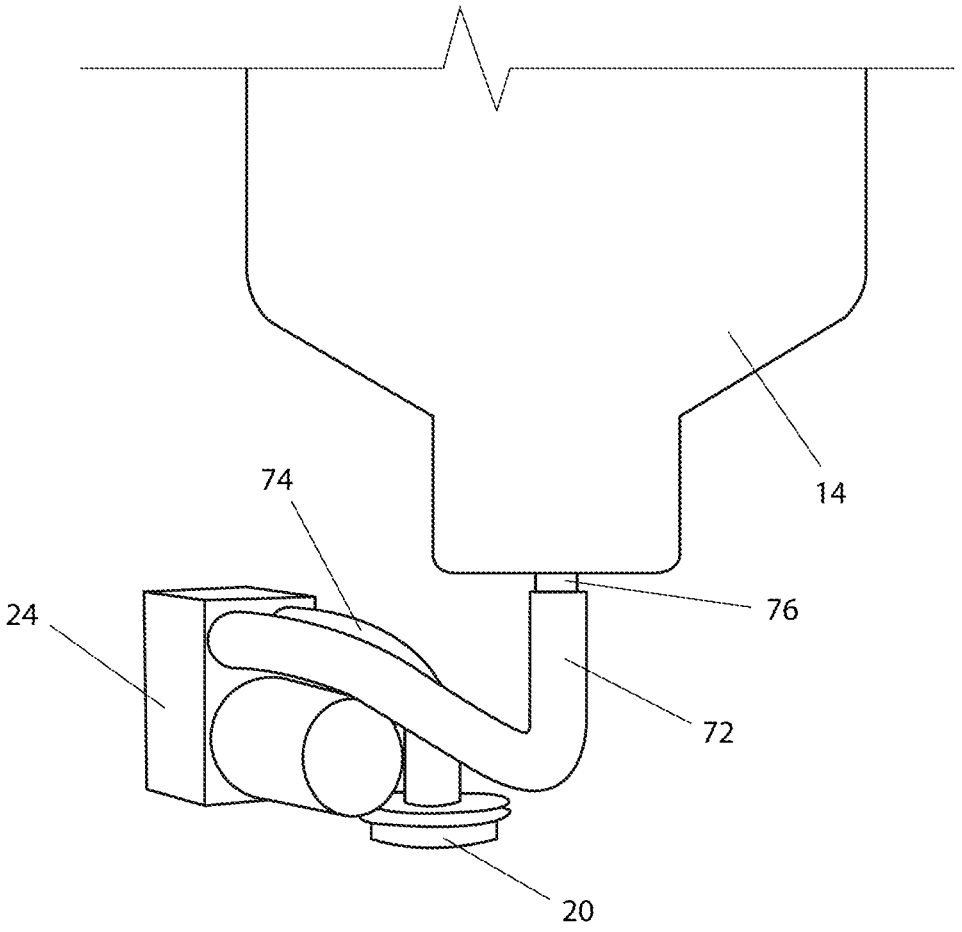
FIG. 3 is a side view of the fluid dispensing elements of the device of FIG. 1.
Figure 4:
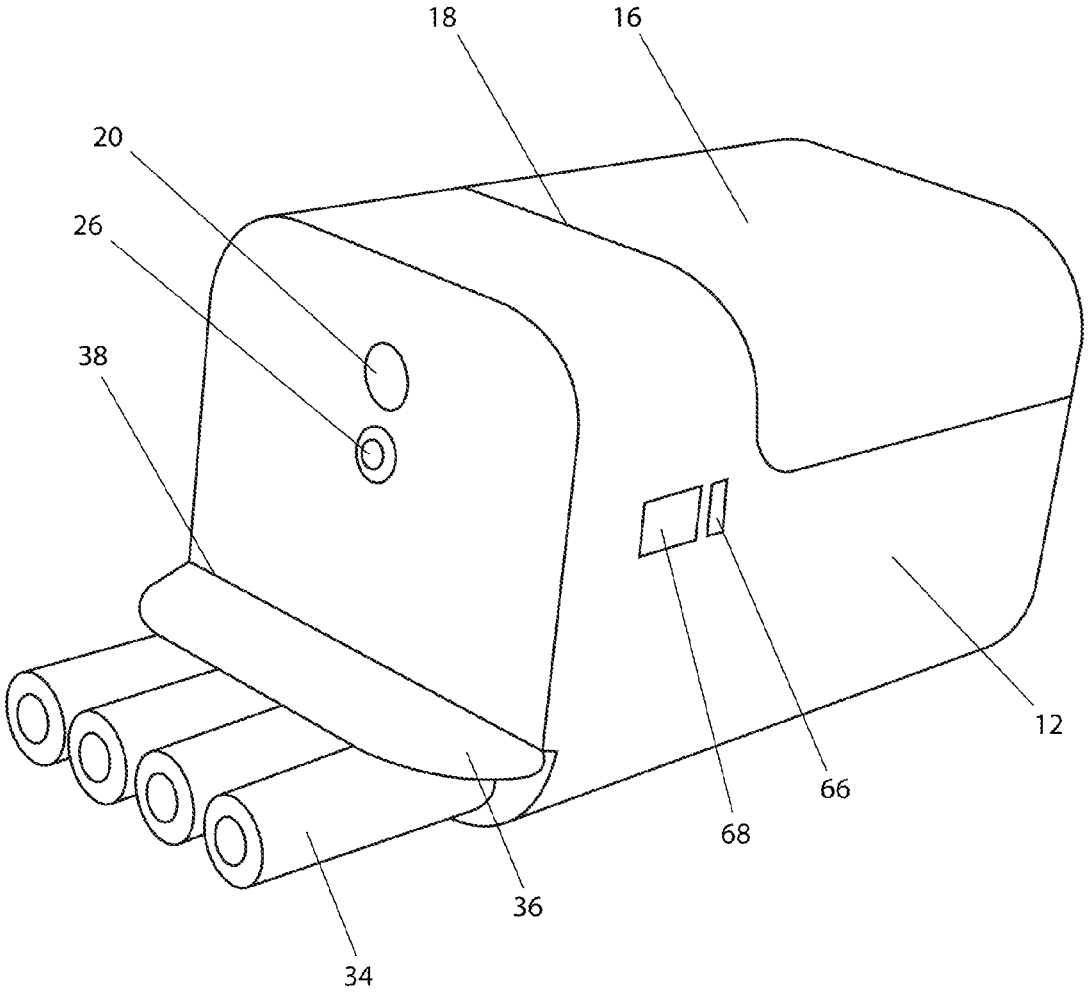
FIG. 4 is bottom elevation view depicting the device of FIG. 1.

In some embodiments, the disconnect mechanism can allow the body 12 to rotate up to 360 degrees of rotation relative to extension arm 44 so as to position apparatus 10 in any desired position. In other embodiments, the hanger member 42 is rotatable within the extension arm 44 so that the hanger member 42 can rotate up to 360 degrees relative to the extension arm 44. It is also contemplated that the hanger member 42 may be horizontally rotatable relative to the extension arm 44 so that the body 12 can be suspended in a substantially vertical orientation. For example, this may be accomplished by having a curved member 58, which may be a sphere or crescent, operatively connected to the hanger member 42 and which interacts with the inner surface of the top wall of the extension arm 44, as shown in FIG. 2.

It is preferred that the components of the apparatus 10 are positioned within the body 12 such that they are centrally weighted so that when in use the fluid rests substantially level within the fluid container 14. The apparatus 10, as a whole, may hang substantially vertically. It is contemplated that a counter weight (not shown) may be incorporated into the apparatus 10 to allow for suitable balancing. This counter weight may be a magnet. Where the counter weight is a magnet it may have a secondary function of magnetically attaching the apparatus 10 to a metal surface or object.

The body 12 may have disposed thereon a light 66, which may indicate one or a number of things to a user. It is contemplated that the light 66 may be a multicoloured light to provide more than one piece of information to the user, for example the fluid level, the battery power and/or whether the apparatus is on or off. The body 12 may also have disposed thereon a power switch 68 to allow the user to turn the apparatus on and off to limit battery use or accidental activation. There are a number of possible options for the light 66 and the power switch 68, which would be well known to a person of skill in the art.

In operation, apparatus 10 is placed onto a paper roll holder or support, such as is shown in FIGS. 5A and 5B. A piece of cleaning material can be placed beneath apparatus 10 to be moistened. When the material is placed near or proximate to the motion sensor 26, the motion sensor 26 can send an electrical signal to the control circuit 30 that can, in turn, actuate the fluid pump 24 to pump an amount of fluid from fluid container 14 out the nozzle 20. The amount of fluid dispensed can be in the range of 0.5 ml to 3 ml, although the amount of dispensed fluid can be of any desired amount. The fluid dispensed can be in liquid or foam form and may consist of, for example, water, purified water or aloe Vera water either alone or combined with a salt-water or saline solution or any other suitable fluid for moistening cleaning materials, as well known to those skilled in the art.

In some embodiments, the fluid container 14 can be sized to hold enough fluid for approximately 75 uses, or otherwise have a fluid capacity in the range of 40 ml to 225 ml or more. When the fluid container 14 becomes depleted, the body 12 can be detached from extension arm 44 by operating the disconnect mechanism so that the fluid container 14 can be easily refilled. Once refilled, the body 12 can be reattached to the extension arm 44 via the disconnect mechanism.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

The scope of the claims should not be limited by the embodiments as set forth in the examples herein, but should be given the broadest interpretation consistent with the description as a whole.

I claim:

1. An apparatus for moistening a cleaning material prior to use, the apparatus comprising:

a hanger member configured for suspending the apparatus from a support;

a body comprising a bottom end face that defines an opening, the body operatively coupled to the hanger member;

a fluid container operatively coupled to the body, the fluid container configured for storing fluid for moistening the cleaning material;

an extension arm comprising a top wall having an inner surface, the extension arm being disposed between the hanger member and the fluid container;

a curved member operatively connected to the hanger element and abutting the inner surface of the top wall of the extension arm;

a fluid pump in communication with the fluid container;

a nozzle in communication with the fluid pump and operatively coupled to the bottom end face of the body so that fluid is dispensed downwardly by way of the opening in the bottom end face of the body;

a control circuit operatively coupled to the fluid pump;

a source of electrical power operatively coupled to the control circuit;

a motion sensor operatively coupled to the control circuit and positioned proximate to the nozzle to sense motion below the bottom end face of the body, whereupon the movement of a person's body part proximate to the motion sensor will cause the fluid pump to dispense an amount of fluid from the fluid container out of the nozzle to moisten the cleaning material.

2. The apparatus as set forth in claim 1, further comprising a disconnect mechanism disposed between the extension arm and the fluid container, the disconnect mechanism configured for releasably attaching the fluid container to the extension arm.

3. The apparatus as set forth in claim 1, wherein the motion sensor comprises one or more of a group consisting of capacitive motion sensors and infrared motion sensors.

4. The apparatus as set forth in claim 1, wherein the source of electrical power comprises at least one battery.

5. The apparatus as set forth in claim 1, further comprising a switch disposed on the body and operatively coupled to the source of electrical power, wherein the switch controls the delivery of electrical power to the control circuit.

6. A method for moistening a cleaning material, the method comprising the steps of:

providing an apparatus for moistening the cleaning material prior to use, the apparatus comprising:

a hanger member configured for suspending the apparatus from a support;

a body operatively coupled to the hanger member;

a fluid container operatively coupled to the body, the fluid container configured for storing fluid for moistening the cleaning material;

a fluid pump in communication with the fluid container;

an extension aim comprising a to wall having an inner surface, the extension arm being disposed between the hanger member and the fluid container;

a curved member operatively connected to the hanger element and abutting the inner surface of the top wall of the extension arm;

a nozzle in communication with the fluid pump;

a control circuit operatively coupled to the fluid pump;

a source of electrical power operatively coupled to the control circuit and the fluid pump; and a motion sensor operatively coupled to the control circuit, whereupon the movement of a person's body part proximate to the motion sensor will cause the pump to dispense an amount of fluid from the fluid container out the nozzle to moisten the cleaning material;

mounting the apparatus on a support;

taking a section of cleaning material and placing it beneath the nozzle; and dispensing the amount of fluid onto the section of cleaning material.

7. The method as set forth in claim 6, wherein the apparatus further comprises a quick disconnect mechanism disposed between the extension arm and the fluid container, the quick disconnect mechanism configured for releasably attaching the fluid container to the extension arm.

8. The method as set forth in claim 6, wherein the source of electrical power comprises at least one battery.

* * * * *